United States Patent [19]

Kettle et al.

[11] Patent Number: 5,074,399

[45] Date of Patent: Dec. 24, 1991

[54] ORIENTATION OF CONTAINERS

[75] Inventors: Andrew T. Kettle, Crawley; Eric Spooner, Horsham, both of England

[73] Assignee: CMB Foodcan plc, Berkshire, England

[21] Appl. No.: 569,384

[22] Filed: Aug. 15, 1990

Related U.S. Application Data

[63] Continuation of Ser. No. 279,049, Dec. 2, 1988, abandoned.

[30] Foreign Application Priority Data

Dec. 4, 1987 [GB] United Kingdom ..... 8728486

[51] Int. Cl.[5] ..... B65G 47/244

[52] U.S. Cl. ..... 198/395; 198/379

[58] Field of Search ..... 198/379, 394, 395

[56] References Cited

U.S. PATENT DOCUMENTS

| | | | |
|---|---|---|---|
| 2,293,553 | 8/1942 | Magnusson | 198/394 |
| 2,734,619 | 2/1956 | Lebombarde | 198/379 |
| 3,415,350 | 12/1968 | Murphy | 198/395 X |
| 3,527,334 | 8/1970 | Wideman | 198/379 |
| 3,541,751 | 11/1970 | Quebe et al. | 198/395 X |
| 3,580,380 | 5/1971 | Phillips | 198/376 |
| 3,934,714 | 1/1976 | Matsumoto | 198/379 |
| 4,074,130 | 2/1978 | Messman et al. | 250/223 R |
| 4,143,754 | 3/1979 | Eldred | 198/394 X |
| 4,561,534 | 12/1985 | Nalbach | 198/395 X |

*Primary Examiner*—Robert P. Olszewski
*Assistant Examiner*—James R. Bidwell
*Attorney, Agent, or Firm*—Watson, Cole, Grindle & Watson

[57] ABSTRACT

A method and apparatus are described for angularly orientating the beverage cans of multipacks 12 having sheet plastics couplers. The preformed multipacks, with their cans unorientated, are fed between a pair of opposed scrolls 36 of a can orientation station 34. While held by the scrolls against lateral movement they are clamped longitudinally and then individually rotated to desired orientated positions against the frictional resistance presented by the coupler. Orientation is achieved in two stages, in the first stage of which the cans are orientated to datum positions as determined by sensor recognition features on the can. In the second stage of the orientation process the cans are individually rotated from their datum positions to their desired final orientation in accordance with preset programmes.

6 Claims, 11 Drawing Sheets

64
65

ORIENTATION OF CONTAINERS

This application is a continuation of application Ser. No. 279,049, filed Dec. 2, 88, now abandoned.

This invention relates to the orientation of containers, and particularly concerns the orientation of containers which are grouped together in multipacks each formed of an array of the containers, and a coupler by which the containers of the multipack are releasably attached together. The multipacks most commonly available have a 2×2 or 2×3 array of containers, although other arrays are possible.

For commercial or other reasons it may be desirable for the containers of a container multipack to be each angularly orientated, for example so that the containers present their labels in a uniform and attractive manner to the potential purchaser.

In the application of the couplers to the containers, the latter are marshalled so as to pass along a conveyor in the number of rows or columns required in each multipack, and the couplers are applied to them so as to form multipacks in succession from the foremost containers on the conveyor, in batches of the appropriate number.

In seeking to provide a method and apparatus for orientating beverage cans of a multipack having a sheet plastics coupler as currently marketed in GB under the trade name Hi-Cone, Applicants first considered orientating the containers prior to the application of the coupler. However, this proposal was found to be subject to various shortcomings; in particular, the need to prevent the containers from inadvertent rotation between the orientation of the containers and the subsequent application of the coupler was considered to require the containers to be positively clamped or otherwise held against rotation during that time, and this in turn demanded that the orientation and coupler application devices should be closely linked so that the container holding could be effective between them.

The provision of a suitable container holding arrangement and the close linking of the orientation and coupler application devices resulted in considerable complexity and lack of flexibility in arrangement and operation, but Applicants realised that by orientating the containers after application of the coupler and whilst already incorporated into the container multipack, the coupler itself could be made to prevent inadvertent rotation of the individual containers from their desired orientated positions; moreover, container orientation and coupler application could be effected independently and at remote localities if desired.

UK Patent specification No. 1247450 discloses such an apparatus by which containers of a container multipack are oriented after application of the coupler. However, in 1247450 orientation is effected in a single stage which terminates when a mark on the container is sensed. Applicants believe that because of interference between the containers of the multipack and the limited arc in which the sensors can therefore be placed, and because, furthermore, of limitations inherent in the recognition of marks or other features in an unambiguous manner, such single stage sensing will impose limitations on the angular position to which the containers can be orientated; moreover, it will usually require the sensing marks to be specially printed on the container if ambiguity is to be avoided.

In accordance with the invention from one aspect there is provided a method of individually orientating to desired angular positions the containers of a multipack of generally cylindrical containers disposed in an array and coupled together by a packaging coupler, the coupler allowing scanning access to the containers and presenting them with a substantial resistance to rotation, the method comprising: receiving the preformed multipack with the containers unorientated; driving the containers to rotate about their cylindrical axes; scanning the rotating containers individually for unique features thereon and producing a recognition signal output when the said unique feature is recognised, the container then having a datum angular position, and subsequent to the production of the respective said recognition signal or signals driving at least one of the containers to rotate further through a predetermined angle and with a predetermined direction of rotation, after such further rotation of the said at least one container the containers all having their said desired angular positions.

In contrast with the orientation method disclosed in UK Patent Specification 1247450, the method defined in the preceding paragraph uses a second stage of orientation of one or more of the containers. In this orientation stage the angular movement of a container and its direction can be predetermined by the operator and is not under the control of the sensor as was the first orientation stage. Thus there need be no limit to the positions to which the containers may be orientated, and moreover the positions can be independent of one another. By use of a suitable programme the desired angular positions to which the containers require to be oriented can be preset quickly and as desired to meet different production requirements; also, provided that a unique mark (or other feature) is available somewhere on each container for the purposes of the first orientation stage, there need be no requirement for marks to be specially printed on the containers.

Preferably, the method forming the first aspect of the present invention includes ceasing the driving of each container in response to the respective recognition signal, determining when recognition signals have been produced for all the containers of the multipack, and driving the said at least one container to rotate further on such determination. Such an arrangement is specifically described with reference to the accompanying drawings; as an alternative, however, for each container the second stage of operation (where requested) may follow the first stage immediately after the recognition signal is produced, without a possible delay to await the production of a recognition signal for any of the other containers.

In accordance with a second aspect of the invention there is provided an apparatus for individually orientating the predetermined angular positions of the containers of a multipack of generally cylindrical containers disposed in an array and coupled together by a packaging coupler, the coupler allowing scanning access to the containers and presenting them with a substantial resistance to rotation, the apparatus comprising infeed conveyor means for receiving a plurality of said multipacks in succession with their generally cylindrical containers unorientated, and container orientation means to which the multipacks are presented in turn by the conveyor means, the orientation means comprising, for each container of a said multipack, sensor means for recognising a unique feature of the container as it rotates and producing a recognition signal in response thereto, drive means responsive to the output from the sensor means and arranged for driving the container to rotate until such time as the recognition signal is produced, the container then having a datum angular position, and programming means operable after the appearance of the recognition signal to cause the drive means to rotate the container further through a predetermined angular position and with a predetermined direction of rotation to its desired angular position.

As in the described embodiment, the apparatus may advantageously include logic means responsive to the outputs from the sensor means for producing a further signal when recognition signals have been produced for all the containers of the multipack, and programming means responsive to the further signal to control the drive means to rotate one or more of the containers further through a predetermined angular position and with a predetermined direction of rotation, after such further rotation the containers all having their desired angular positions.

These and other aspects and features of the invention will become apparent from the following description of an apparatus embodying the invention, now to be described, by way of example, with reference to the accompanying drawings. In the drawings:

FIGS. 1A, 1B and 1C together show the general arrangement of the apparatus as seen in side elevation;

Figure 1A:
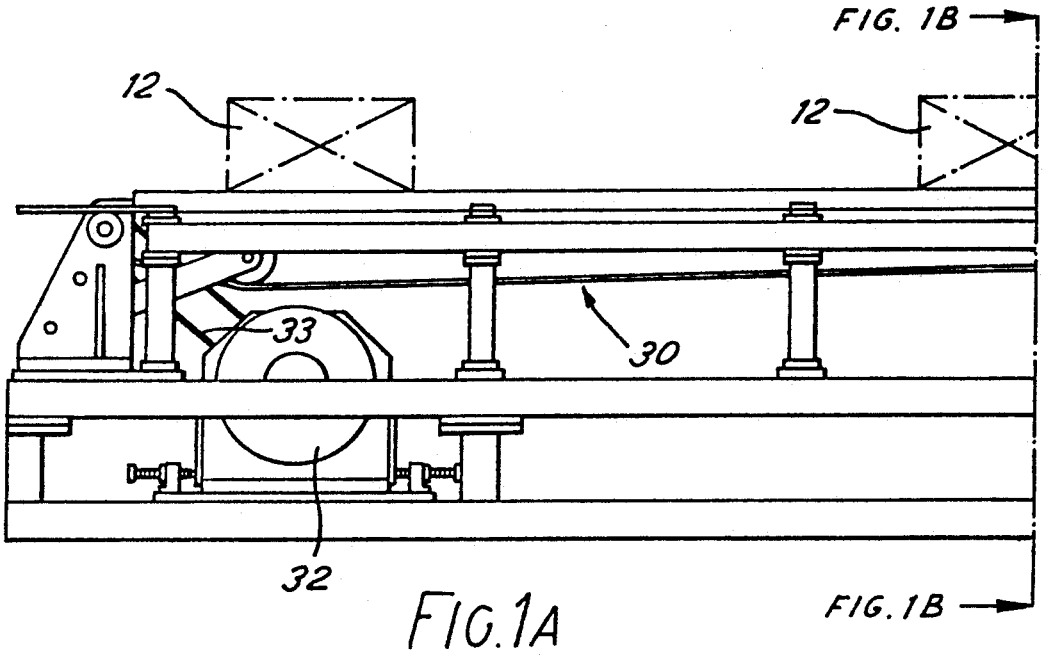
Figure 1C:
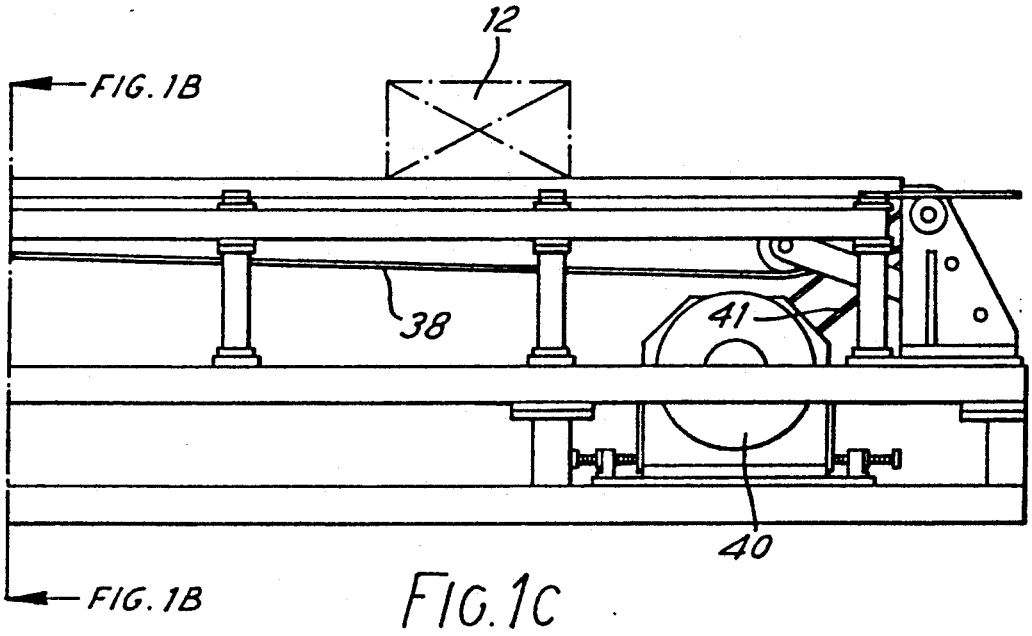
Figure 1B:
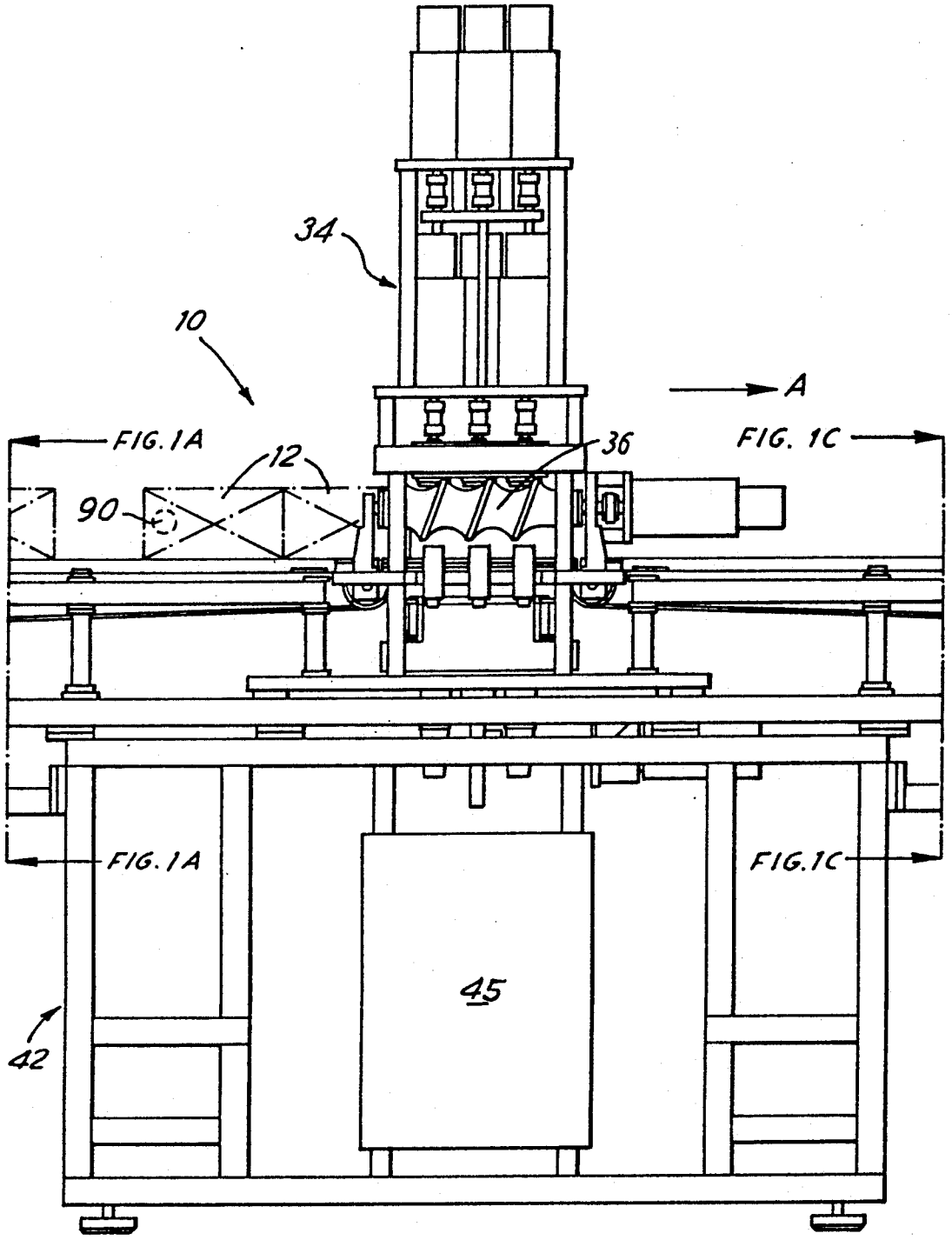

Referring firstly to FIG. 1, an apparatus 10 is shown for performing can orientation operations on conventional multipacks 12 of easy-opening beverage cans as they pass through the apparatus from left to right, as indicated generally by the arrow A. For clarity the multipacks are represented in FIG. 1 only diagrammatically and in broken outline.

Figure 2A:
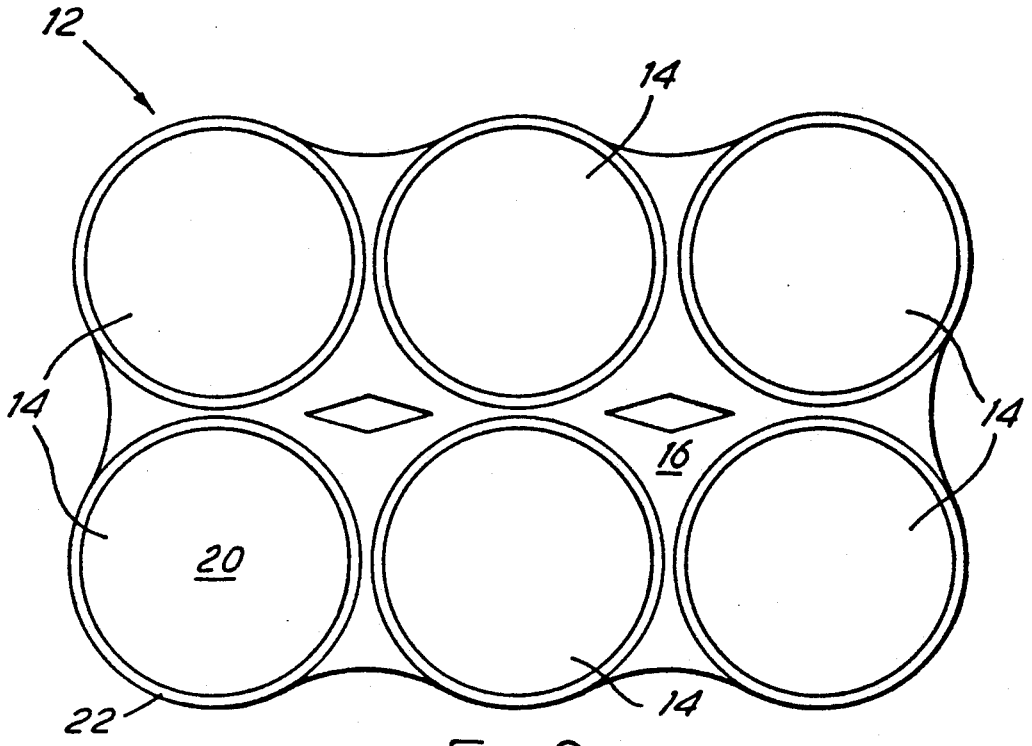
FIGS. 2A and 2B show, in plan view and side elevation respectively, a can multipack of the kind for which the apparatus is designed.
Figure 2B:
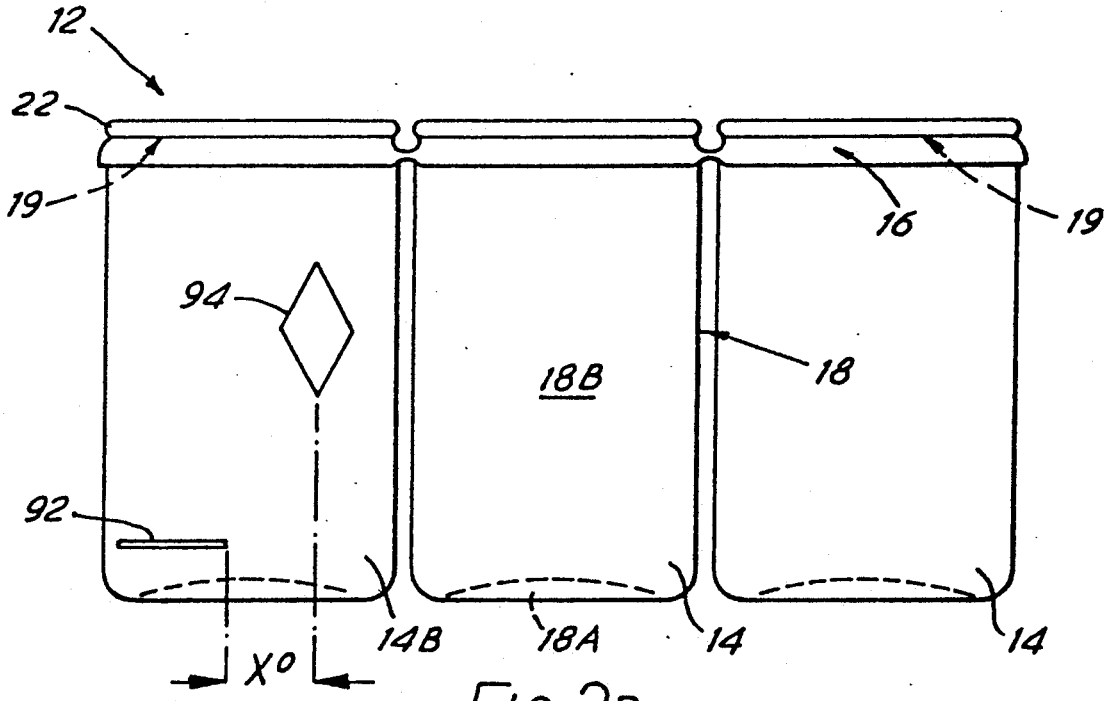

FIGS. 2A and 2B show one of the multipacks 12 in plan view and side elevation respectively. The multipack is formed of six of the beverage cans 14 which are arranged in 2×3 array, and a sheet plastics coupler 16. The cans 14 are conventionally formed from a drawn and wall ironed (DWI) metal body 18 with an integral recessed base 18A and cylindrical side wall 18B, and an easy-opening end closure 20 which is attached to the body at a peripheral double-seam 22. The can body is reduced in diameter immediately below the double seam to produce a neck formation 19. The coupler has apertures which are located and dimensioned to engage the can necks, the double-seams 22 of the cans projecting above the coupler to hold the cans captive.

For clarity the apertures of the coupler are not referenced in the drawings. It is to be understood, however, that they are naturally somewhat smaller in diameter than the can necks 19 so that the cans are resiliently held by the coupler but may each be readily separated from the multipack as and when required by an upward tilting action. Also omitted from the drawings are the pull tabs and associated score lines etc. of the easy-opening end closures 20, by which the cans 14 may be opened.

Sheet plastics couplers 16 of the kind shown in FIG. 2, and multipacks 12 formed from them, have been commercially available in GB for many years. The couplers are marketed in GB under the trade name Hi-Cone.

Reverting again to FIG. 1, preformed multipacks 12 arrive end-to-end in succession on the upper run of a belt conveyor 30 which forms an infeed conveyor for the apparatus. The belt 30 is circulated continuously in the appropriate direction by an electric motor 32 and belt drive 33, but is capable of slipping in relation to the multipacks 12 so as by frictional engagement with the bases of the cans to create a continuous infeed pressure by which the multipacks are driven in turn to the orientation station which follows.

The orientation station is indicated generally by the reference numeral 34. It has a pair of horizontally opposed, intermittently rotating scrolls 36 by which the cans of each multipack in turn are controlled for movement into the station 34, held against any substantial horizontal movement in the station 34 whilst orientation is proceeding, and after can orientation are progressed from the station onto a further horizontal belt conveyor 38 which carries the multipack away for overwrapping (if required) and despatch.

The discharge conveyor 38 is similar to the infeed conveyor 30 and is likewise driven by an electric motor 40 and belt drive 41. It may be driven continuously, or intermittently in synchronism with the scrolls 36.

The infeed and discharge conveyors 30, 38, the orientation station 34, and a cabinet 45 containing the associated electrical supply and control equipment are mounted on a frame 42, the apparatus as a whole accordingly being a self-supporting and mobile unit which can readily be introduced into the discharge end of an existing Hi-Cone coupler application line, little or no modification of the latter being then required except, possibly, to introduce a break in the discharge conveyor upstream of any tray packer.

Figure 3A:
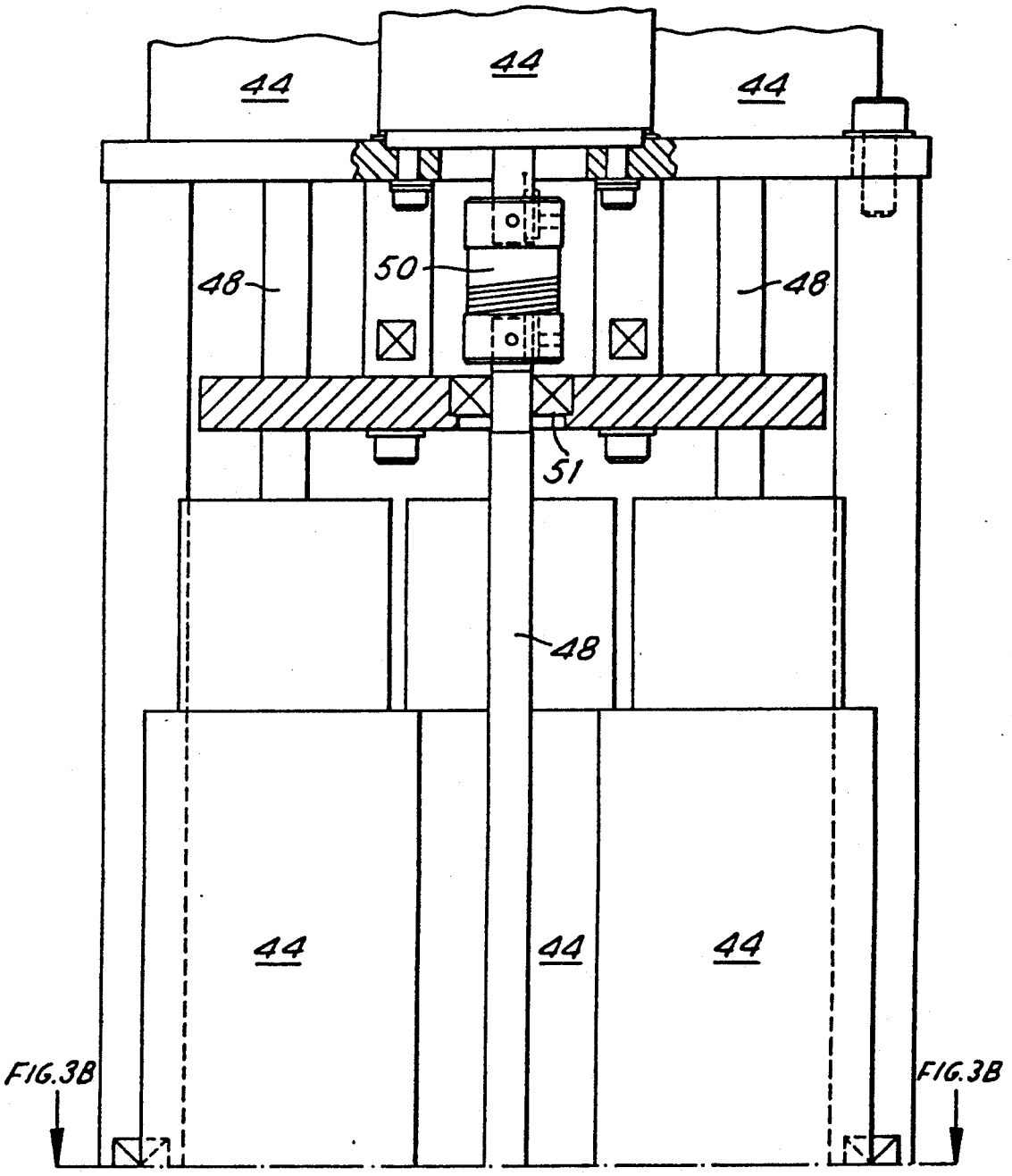
FIGS. 3A and 3B show upper and lower parts respectively of the can orientation station of the apparatus of FIG. 1, as seen in side elevation but with the scrolls omitted for clarity.
Figure 3B:
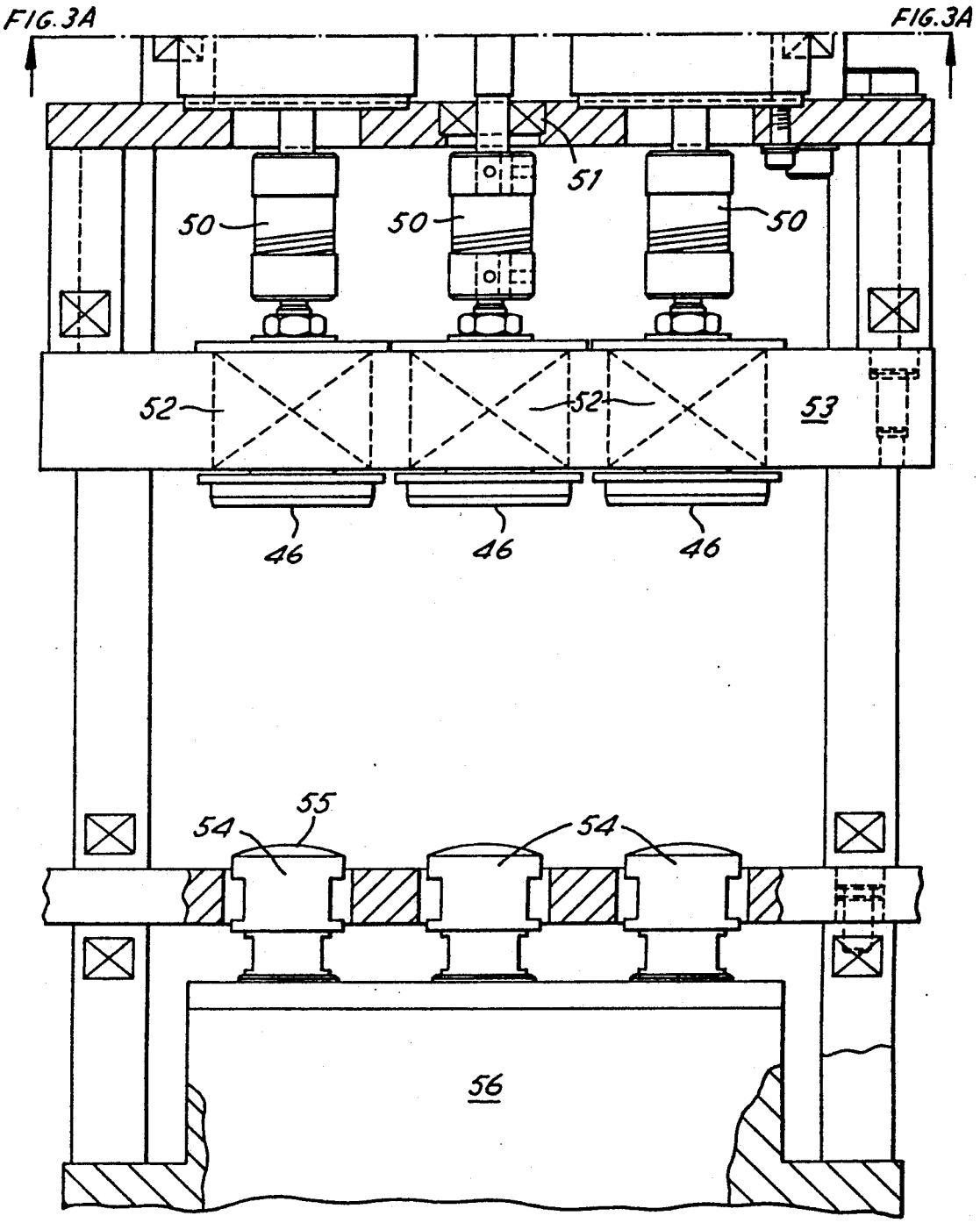

The arrangement of the orientating station 34 (with the scrolls 36 omitted for clarity) is shown in FIGS. 3A and 3B. From those drawings it will be seen that the orientation station includes six d.c. drive motors 44 one for each can of a multipack 12 held by the scrolls 36, six chucks 46 arranged on a common horizontal plane and dimensioned for engaging frictionally within the easy-open end closures 20 of those cans 14, and vertical shafts 48 and couplings 50 by which the chucks are connected to respective ones of the drive motors 44.

The apparatus is arranged to operate upon the multipacks with their major axes aligned longitudinally, so that the multipacks as they pass through the apparatus are three cans long by two cans wide. Because space requirements prevent their arrangement in a common horizontal plane, the drive motors 44 are arranged in two tiers of three, the upper tier being formed of the drive motors provided for orientation of the two outer ones of the three cans of the back row (as seen in FIG. 1) together with the centre can of the front row, the drive motors of the lower tier correspondingly serving for the two outer cans of the front row and the centre can of the back row.

The shafts 48 connect the drive motors of the upper tier to their respective chucks 46 via couplings 50 at their top and bottom ends. The drive motors of the lower tier are connected directly to their associated chucks by further ones of the couplings 50.

Each of the six motors 44 is rigidly supported from the machine frame 42, and suitable thrust or rotary bearings are provided on the frame to support the chucks against longitudinal movement and journal the shafts accurately for rotation; for example, rotary bearings are shown and indicated by the reference numeral 51 in FIGS. 3A and 3B for one of the shafts 48. A thrust bearing 52, shown only diagrammatically (FIG. 3B), is provided for each chuck 46 on a cross member 53 of the frame.

Figure 4A:
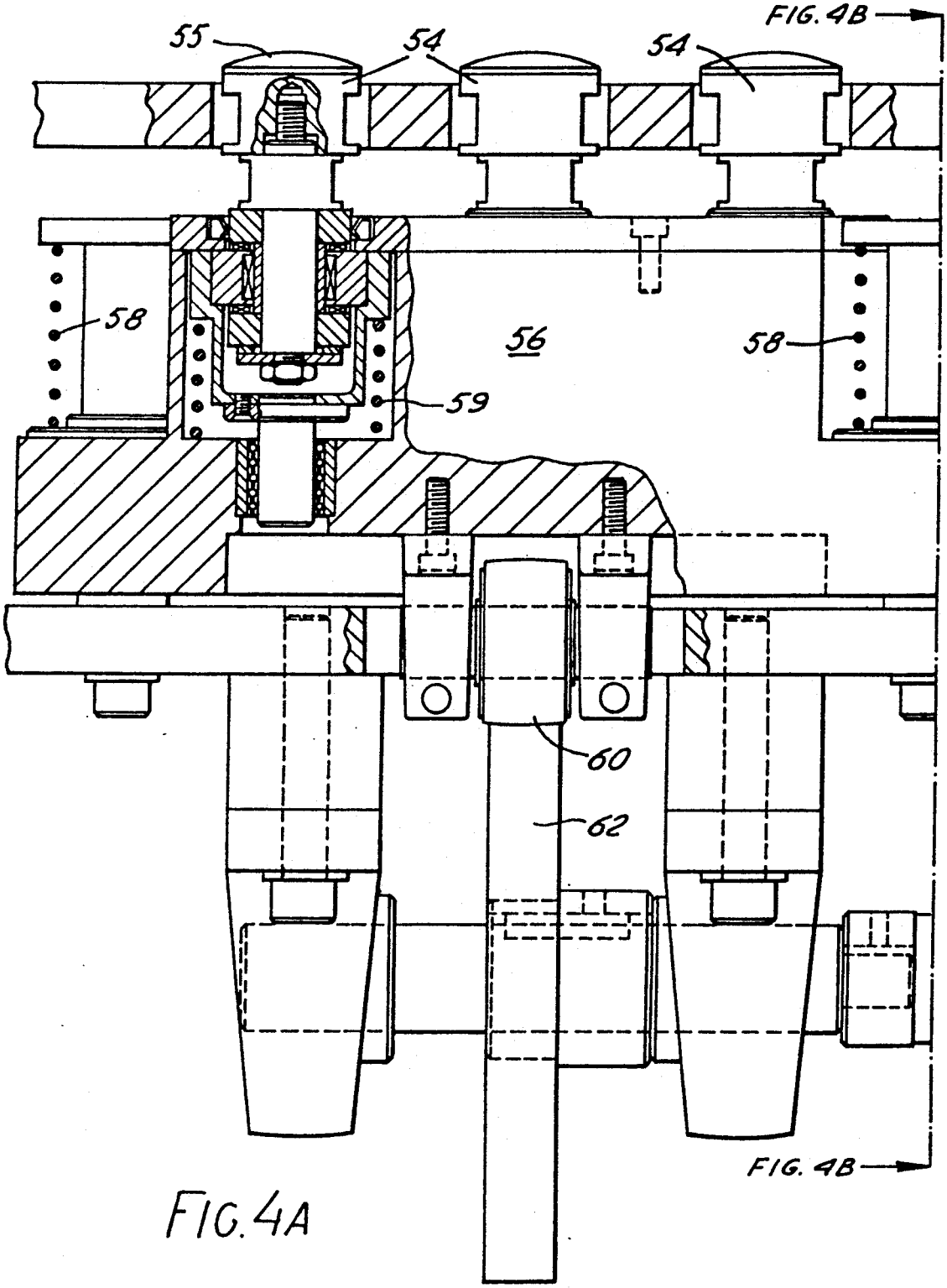
FIGS. 4A and 4B show the lower part of the can orientation station in detail.
Figures 4A, 4B:
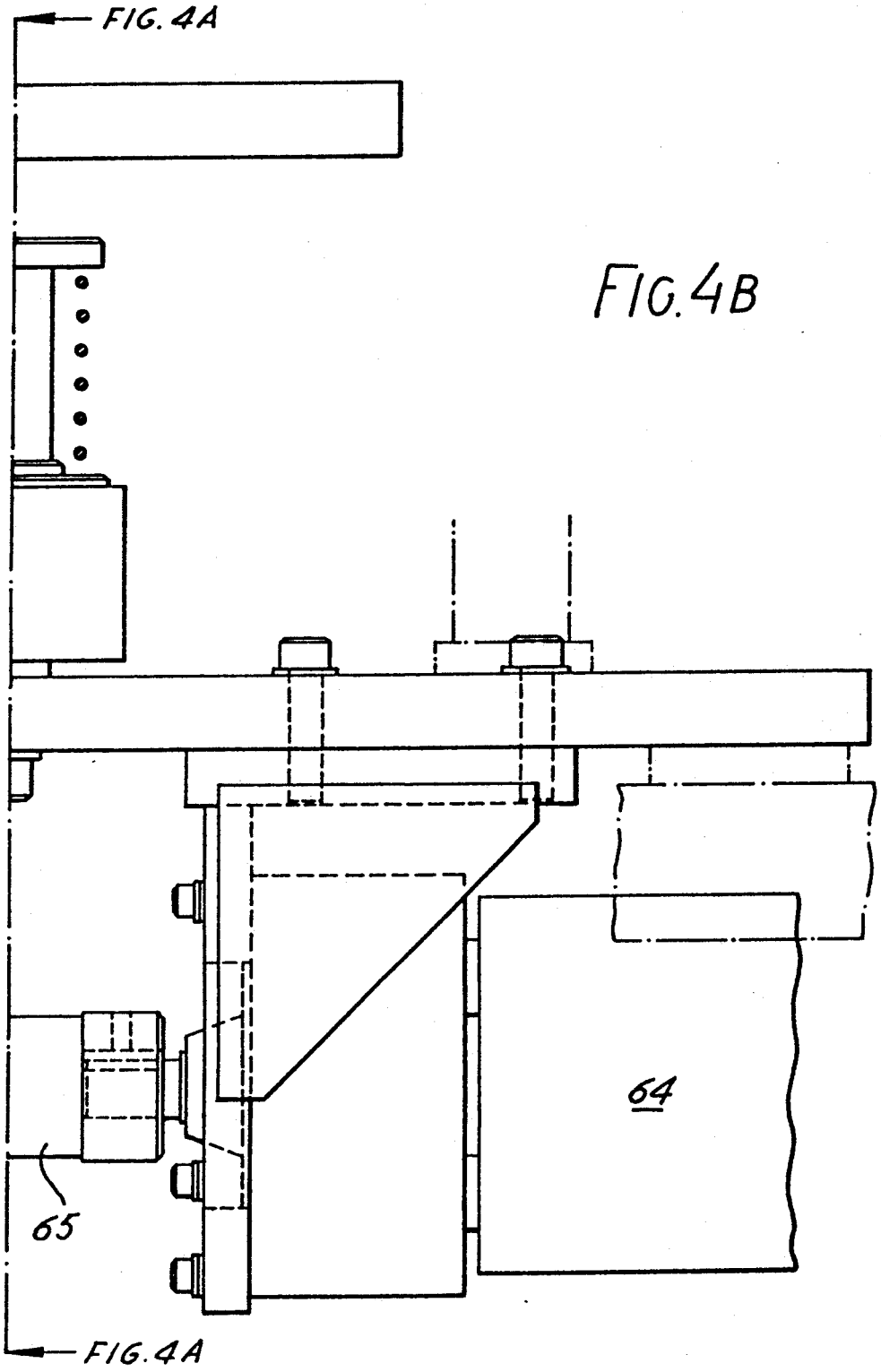

Below the level of the scrolls 36, in vertical opposition to the chucks 46, the orientation station 34 has six lifter pads 54 which have rounded domes to engage within the base recesses of the cans 14 and are freely rotatable on a vertically reciprocable crossarm 56. FIG. 4 shows how the lifter pads are supported and the crossarm is reciprocated.

Referring now to FIG. 4, the crossarm 56 is guided for vertical movement on the machine frame, and is biased downwardly in relation to it by light compression springs 58 to prevent chatter. Rotatably mounted on the crossarm is the roller follower 60 for a cam 62 which is arranged to be driven by a d.c. drive motor 64 via a coupling 65. By rotation of the motor 64 the cam may be caused to raise the crossarm and accordingly the lifter pads 54, thereby clamping the cans 14 in the scrolls 36 against the chucks 46. The scrolls are sufficiently loosely engaged with the cans to allow the small vertical movement which is required for clamping, and to allow rotation of the cans for orientation (as is later to be described). Further compression springs 59 provide resilience for the lifter pads 54 during clamping so as to control the axial loading which is applied to the cans to within predetermined limits.

Figure 5A:
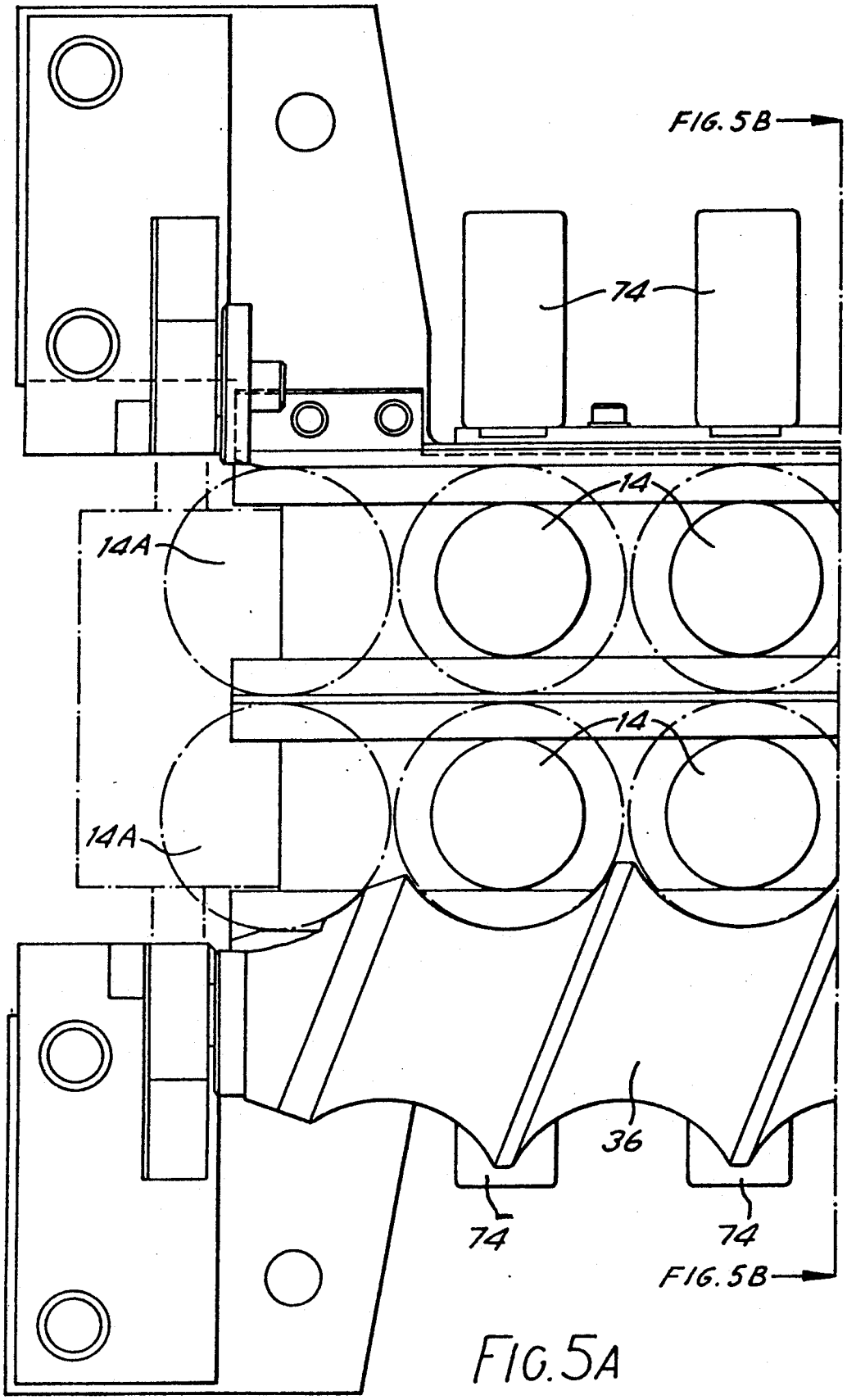
FIGS. 5A and 5B show, in plan view, the arrangement of the scrolls by which the cans are carried into, through, and out of the can orientation station.
Figure 5B:
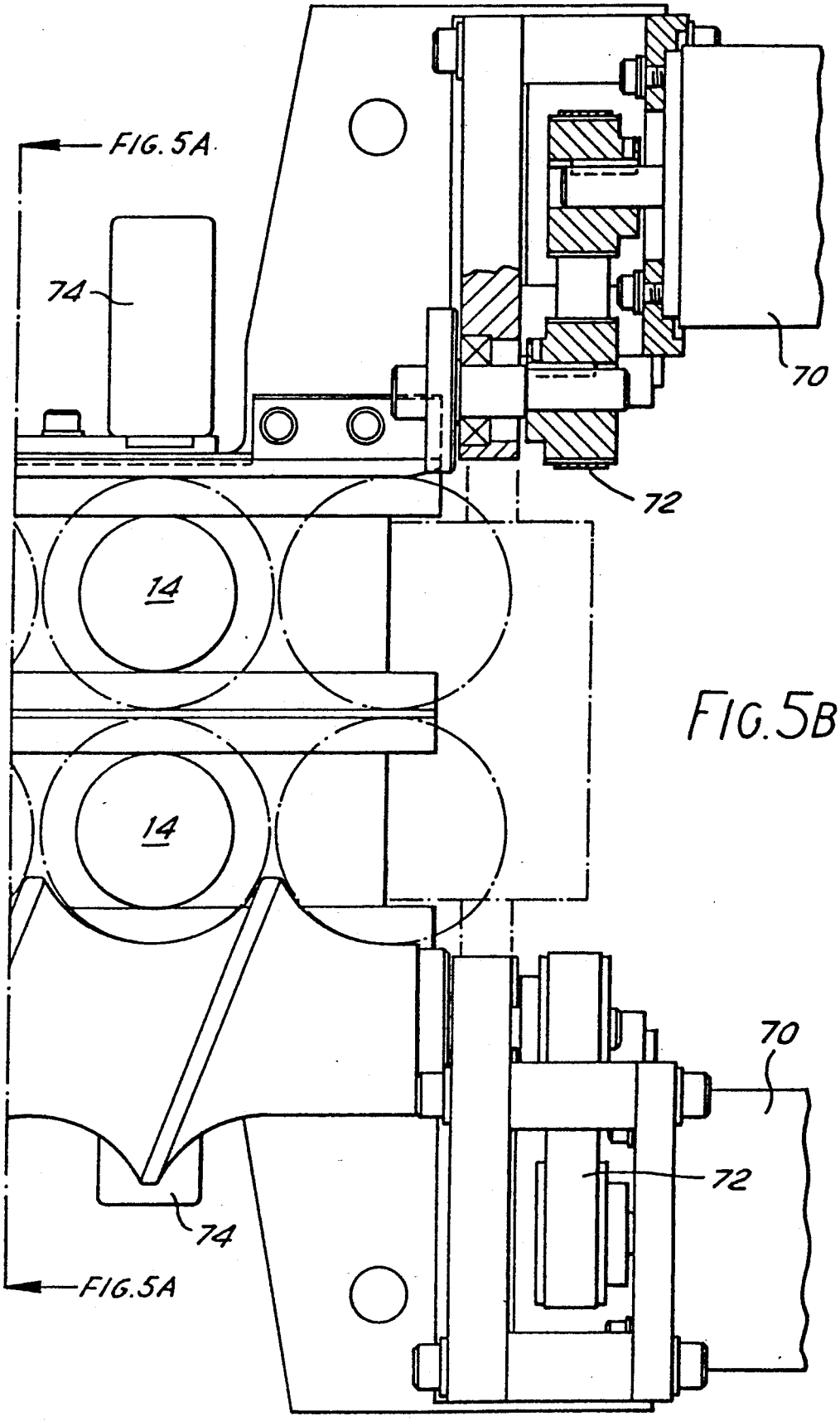
Figure 6:
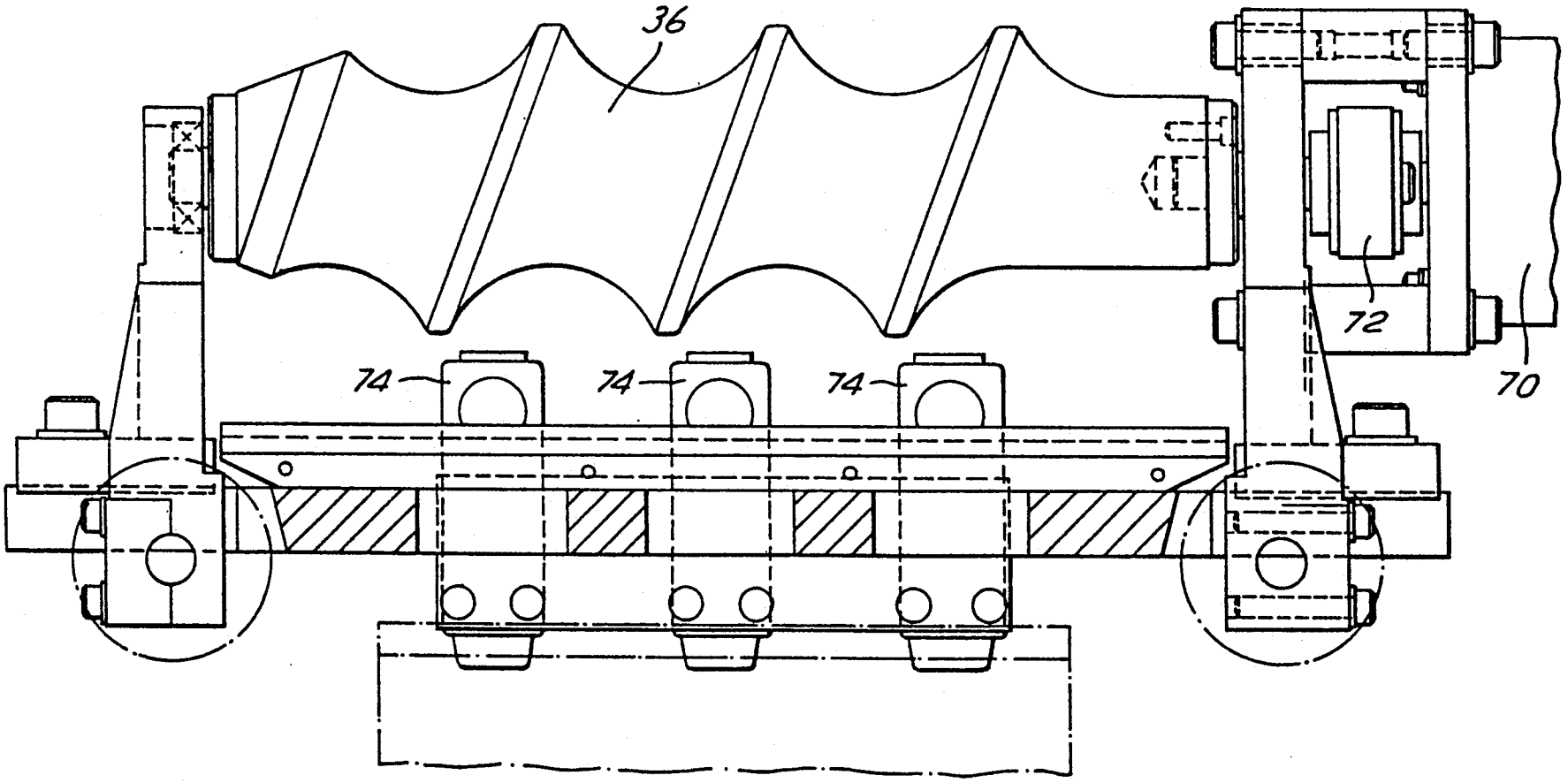
FIG. 6 is a side elevation corresponding to FIG. 5, showing one scroll and the can sensors associated with the other scroll (not visable)

FIGS. 5 and 6 show the scrolls 36 in detail. Each scroll has an open-ended screw thread formed of four complete turns. The scrolls are spaced apart, and their threads are of opposite hand so that the cans of a multipack can be received between them as shown in FIG. 5, with each scroll in nested engagement with the three cans of the adjacent row.

For clarity only one scroll is shown in FIG. 5, the other scroll being omitted. D.c. drive motors 70 connected to the scrolls by belts 72 enable the scrolls to be driven intermittently in opposite directions three turns at a time, in a sense to drive a multipack from left to right as shown.

Further shown in FIGS. 5 and 6 are sensors 74 which are mounted on the machine frame adjacent and below the scrolls, in positions to scan the bottom ends of the side walls 14B of cans which are located between the scrolls. These sensors are associated with electrical circuitry included within the cabinet 41 (FIG. 1B) and include light emitters which are energised to generate regular pulses of light which are directed at the cans. The reflections of the pulses from the cans are sensed by the sensors and are individually categorised by the electrical circuitry as being either "light" or "dark" depending upon whether or not they exceed a predetermined threshold level of light intensity. The function of the sensors and their manner of operation will become apparent from the following description of the apparatus in operation.

In use of the apparatus, preformed multipacks 12 placed manually or otherwise on the infeed conveyor 30 are advanced towards the orientation station 34 and accumulate end-to-end at the entrance to the scrolls 36. As previously mentioned, the orientation station 34 receives the multipacks one at a time and holds them during orientation. In order to ensure proper feeding of multipacks into and through the orientation station, the orientation cycle which is to be performed by the orientation station is made subject to the output signal from a sensor 90 (FIG. 1B) indicative that at least two multipacks are waiting end-to-end on the infeed conveyor.

Let it be initially assumed that a multipack has been located in the orientation station 34 and its cans 14 have been orientated as required; furthermore, the drive motors 44, 64 and 70 are all deenergised, and the cam 62 is angularly positioned so that the crossarm 56 is at the bottom of its travel and the lifter pads 54 are accordingly in the retracted position shown in FIGS. 1, 3 and 4.

The situation is therefore as depicted in FIG. 5, with the cans 14 which have just been orientated lying between the scrolls 36, and with the first pair of cans of the front multipack 12 on the infeed conveyor 30 abutting the upstream ends of the scrolls and held in that position by pressure exerted by the infeed conveyor as previously mentioned. For ease of understanding, the multipack lying between the scrolls is omitted from FIGS. 1, 3, 4 and 6, and the cans of the succeeding multipack are particularly denoted in FIG. 5 by the reference 14A.

Subject to the generation of an appropriate output signal by the sensor 90, the orientation cycle begins with the energisation of the drive motors 70 to rotate the scrolls through three revolutions, thereby ejecting the multipack having the orientated cans onto the discharge conveyor, and replacing it in the orientation station by the succeeding multipack of cans 14A (which at this time are unorientated).

The drive motors 70 are then stopped, and the motor 64 is energised to lift the pads 54 into engagement with the base recesses of the cans 14A. The cans 14A are therefore lifted bodily upwards until their easy-opening closures become engaged frictionally with the chucks 46 to clamp the cans longitudinally. Orientation of each can 14A can then proceed.

Reference is now made again to FIG. 2B showing a multipack 12 in side elevation. It will be understood from FIG. 2B that the six beverage cans 14 of the multipack have their side walls identically printed with promotional and informative material in normal manner. If it is rotated (as is later described) each can will cause the associated sensor 74 (FIGS. 5, 6) to produce a succession of output signals which are individually recognised in the associated electrical circuitry as representing 'light' or 'dark' areas of the can. Each revolution of the can will therefore produce a particular pattern made up of groups of one or more successive 'light' signals alternating with groups of one or more successive 'dark' signals. The electrical circuitry is programmed to recognise a group of signals which always is unique as to its length and identity, and in response to such recognition to produce a recognition signal which is therefore indicative that the can in question has a particular angular orientation.

The group of signals for which the recognition signal is produced is the longest which is produced per revolution of the can, that is to say, it contains the greatest number of successive "light" or "dark" signals. This ensures that a recognition signal cannot be produced incorrectly when rotation of the can is started at a time when the sensor is located part way along a can feature which is associated with a greater potential signal group length than the recognition feature itself.

Although it may be possible to select another feature to serve as the recognition feature, it is usually convenient to use a bar of a bar code which is printed on the container, and in FIG. 2 one bar 92 which is shown for the can particularly denoted 14B serves as the recognition feature, its length being chosen accordingly. For clarity, the remainder of the bar code of the bar 92 is omitted from FIG. 2, as are the bar codes of the other cans 14.

Reverting again to FIG. 5, once the cans 14 have been successfully clamped between the chucks 46 and the lifting pads 54, the drive motors 44 are all energised to rotate the cans while the sensors 74 and their associated circuitry are effective to scan the cans for their bars 92. Immediately the bar 92 on a can is recognised, a recognition signal is produced in response to which the associated drive motor 44 is denergised and the can rotation ceases. For accuracy, the rotation of the cans by the drive motors is effected in small and discrete steps; typically the steps are of 0.18° magnitude, and their frequency is 250,000 per minute at the maximum speed of the drive motor.

In this way the cans are individually (and independantly) rotated as necessary to bring their sensor recognition features in direct opposition to their sensors; they are thereby orientated to known datum angular positions. The sensor recognition features 92, if bar codes, can then be read in known manner if desired.

Once the cans have all been set to their desired datum positions they may then, if desired, be individually orientated to further predetermined positions so as, for example, to present artwork which is printed on their side walls 18B to the best effect. In FIG. 2B the artwork on the can particularly denoted 14B, is represented by a diamond 94 which is angularly displaced by a known angle X from the sensor recognition feature 92. The drive motor 44 associated with the can 14B is accordingly energised to rotate the can through this angle X° [or through the complementary angle (360−X)°] in step increments, the rotation being enabled by production, in a logic circuit (not shown), of a signal which is indicative that the datum positions of all the cans have been achieved. Following the production of this logic signal the drive motors 44 of all the cans requiring further orientation are energised in accordance with individually preset programmes to achieve the desired rotation of their respective cans. The magnitudes of the can movements may differ, as may their directions of rotation.

It is to be particularly noted that because of the frictional engagement made by the coupler 16 with the cans individually (as described above with reference to FIG. 2), any rotational movement of each can within the coupler is resisted. The drive motors 44 are capable of overcoming this resistance and of rotating the cans individually without undue distortion of the coupler. However, after orientation, for example during transit and display of the multipack, the coupler prevents any substantial rotation of the cans so that their desired orientated positions are maintained to the point of sale. The direction of rotation of the cans and the relative timing of the rotation may be chosen to reduce to a minimum the tendency of the coupler to distort whilst orientation is proceeding.

Although particularly described in relation to multipacks having sheet plastics couplers of the Hi-Cone type, the invention may have application to multipacks having other types of plastics coupler or couplers made from another material, e.g. cartonboard. The coupler may therefore be a wrap-around design, such as is marketed in UK under the trade name Jak-et-Pak, providing that sufficient access is available to the individual containers for them to be rotated, and their angular positions to be sensed, for orientation.

Figure 7:
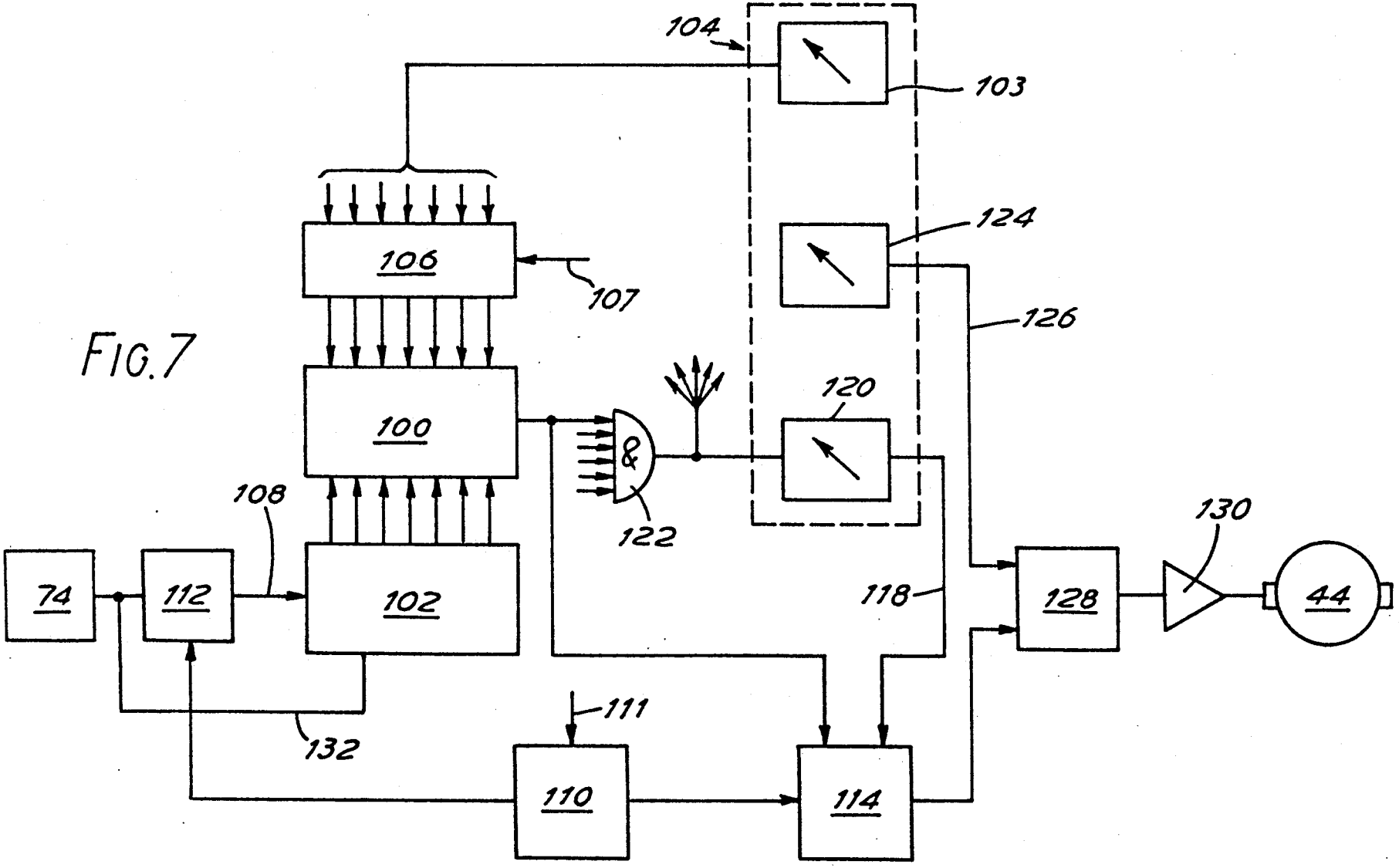
FIG. 7 is a block diagram of the electronic circuitry for controlling the motors which rotate the cans during their orientation.

FIG. 7 shows the circuitry by which the motors 44 are energised to rotate the cans 14 in response to the signals from the sensors 74. For clarity the circuit for only one sensor and its associated motor is shown, but it is to be appreciated that the circuit is generally replicated for the other five sensors and motors.

For each sensor 74 and motor 44 the apparatus has a digital comparator 100 arranged to compare the parallel binary outputs of a counter 102 and of an indexing circuit 103 forming part of a programmer 104. A latching circuit 106 connected between the indexing circuit 103 and the comparator 100 is responsive to an input signal produced on a line 107 when a multipack is in position ready for its cans to be oriented.

The counter 102 receives as input on line 108 a train of pulses which exists when the sensor is scanning a feature on a can 14. The pulses are generated by a constant frequency oscillator 110 in response to a start signal produced on line 111 at the time the input signal is supplied to the latching circuit 106. The pulses are passed to a second latching circuit 112 for which the sensor provides the latching signal. No signal is therefore present on line 108 in the absence of an output from the sensor.

The signal generated by the indexing circuit 103 and passed to the comparator 100 is representative of the length around the can periphery of the bar code 92 (or other can feature) which is to be sensed by the sensor 74 and which is uniquely determinative of the can position. The programmer-generated signal is preset by the operator and can be varied as required for different cans to be oriented.

The output of the comparator 100, indicative of equality of the signals from the counter 102 and the latching circuit 106, is passed as a disabling signal to a logic circuit 114 for interrupting rotation of the can at its angular datum position, as will become clear from the following description. To the logic circuit 114 clock pulses are provided on a line 116 by the oscillator 110. A further input to the logic circuit is an enabling signal provided on a line 118 by a second indexing circuit 120 forming part of the programmer 104.

The enabling signal is produced in response to the output of an AND gate 122 indicative that equality signals have been generated by the comparators for all six motors. Similar output signals from the AND gate 122 are provided to the other five control circuits as indicated.

The indexing circuit 120 can be preset by the operator to represent the angle X° (FIG. 2B) or its complement 360°−X. A third indexing circuit 124 enables the desired direction of rotation of the motor to be entered by the operator and produced as an output signal on a line 126.

A control circuit 128 is connected for receiving the output signal of the logic circuit 114 and the signal on the line 126, and the output signal of the control circuit, after amplification in an amplifier 130, is used to energise the d.c. servo motor 44.

In operation of the circuit shown in FIG. 7, in response to the start-signal on line 111 the oscillator 110 supplies one train of regular pulses to the logic circuit 114 and these are passed on to the control circuit 128 so that the motor 44 is energised to rotate the can, and another train of regular pulses to the latching circuit 112, and these are passed onto the counter 102 during the time that the sensor is energised by a mark on the can. The counter output of the comparator 100 therefore represents the length of the mark being scanned. If the mark being scanned is the recognition mark 92 the counter output will eventually equal the preset output derived from the indexing circuit 103, in which event the comparator produces an output signal which is fed to the logic circuit 114 to cause it to interrupt the supply of signals to the control circuit 128 and hence stop the rotation of the can at its datum angular position. If, however, the mark being scanned is not the recognition mark but instead is another mark of smaller peripheral length, then the comparator produces no output signal and moreover the counter 102 is reset to zero by a signal on a line 132 when the end of the false mark is reached.

When all six of the comparators 100 are producing output signals as described in the preceding paragraph, indicating that the cans have all been turned to their datum angular positions as previously mentioned, the AND gate 122 produces an output signal in response to which the indexing circuit 120 (and its counterparts in the other five circuits) generates on line 118 a signal of which the duration is indicative of the desired magnitude of the further rotational movement required to orientate the associated can in its required final angular position. During the existence of the signal, the logic circuit 114 passes the pulses from the oscillator 110 onto the control circuit 128 for energising the motor 44. The direction of the motor rotation is determined by the signal preset by the operator and generated by the third indexing circuit 124.

Applicants have found that rotating the cans simultaneously in different directions within the packaging coupler 16 (FIG. 2) may result in distortion and possible damage of the coupler and a tendency for the coupler to bind onto the cans, so preventing successful orientation. For each of the stages of orientation therefore, the cans are turned in the same direction. During the second stage of orientation the direction of turning is selected with a view to minimising the time required for orientation.

We claim:

1. A method of individually orientating to desired angular positions the containers of a multipack of generally cylindrical containers disposed in an array and coupled together by a packaging coupler, the coupler allowing scanning access to the containers and presenting them with a substantial resistance to rotation, the method comprising: conveying the preformed multipack with the containers unorientated to a reception station; sensing the presence of the multipack at the reception station and generating a ready signal; actuating intermittently and unidirectionally operable advancing means to engage the multipack at the reception station and advance the multipack to an orientation station following generation of the ready signal; lifting the containers of the multipack at the orientation station into engagement with respective chucks, each of the chucks being coupled to a respective motor to be driven thereby for rotating the container engaged with said chuck; energising the motors to rotate the containers about their cylindrical axes; scanning the rotating containers individually for unique features thereon and for each container producing a recognition signal output when the said unique feature is recognised and stopping rotation of said containers by de-energising the associated motors in response to said recognition signals, whereby the rotation is stopped with the containers at a predetermined datum angular position; for each container having a desired angular position different to said datum position delivering a series of engergising pulses to the associated motor to rotate the container through a predetermined number of incremental angular steps and with a predetermined direction of rotation thereby to bring the container into said desired angular position; and after all the containers have been brought into their said desired angular positions, lowering said containers and actuating said advancing means to deliver the multipack with orientated containers out of the orientation station and simultaneously advance another multipack to the orientation station.

2. The method according to claim 1, which includes stopping rotation of each container in response to the respective recognition signal, determining when recognition signal outputs have been produced for all the containers of the multipack, and rotating the containers further on such determination.

3. The method according to claim 1, wherein the containers of the multipack are all rotated further, through equal predetermined angles and with the same direction of rotation.

4. The method according to claim 2, wherein the containers of the multipack are all rotated further, through equal predetermined angles and with the same direction of rotation.

5. Apparatus for individually orientating to desired angular positions the containers of multipacks each having generally cylindrical containers disposed in an array and coupled together by a packaging coupler, which multipacks are conveyed in succession to a reception station with their containers unoriented, the apparatus comprising means for sensing a multipack at the reception station and emitting a ready signal in response thereto, multipack advancing means operable intermittently and unidirectionally for engaging a multipack at the reception station and advancing the multipack to an orientation station after the ready signal has been emitted by the sensing means, a plurality of chuck means at the orientation station arranged for engagement by the respective containers of the multipack, motors respectively coupled to said chuck means for rotating the chuck means for said containers to rotate with said chuck means, and programmable control means including means for energising the motors to rotate the chuck means and the containers engaged therewith, sensor means for recognising a unique feature of each container as it rotates and producing a recognition signal in response thereto, means responsive to the recognition signal output from the sensor means to stop rotation of said container by de-energising the associated motor whereby rotation is stopped with the container at a predetermined datum angular position, and means operable after the container has been stopped at said datum angular position to cause a series of energising pulses to be delivered to the associated motor to rotate the container through a predetermined number of incremental angular steps and with a predetermined direction of rotation thereby to bring the container to its desired angular position, the advancing means being arranged after the containers have been lowered by the lifting means to deliver the multipack with oriented containers out of the orientation station and simultaneously advance another multipack to the orientation station from the reception station.

6. The apparatus according to claim 5, which includes further means responsive to the outputs from the sensor means for producing a further signal when recognition signals have been produced from all the containers of the multipack, and programming means responsive to the further signal to control the drive means to rotate one or more of the containers further through a predetermined angular position and with a predetermined direction of rotation, after such further rotation the containers all having their desired angular positions.

* * * * *